United States Patent [19]

Hara et al.

[11] Patent Number: 4,567,861

[45] Date of Patent: Feb. 4, 1986

[54] ENGINE VALVE OPERATING SYSTEM FOR INTERNAL COMBUSTION ENGINE

[75] Inventors: Seinosuke Hara, Yokosuka; Yasuo Matsumoto, Yokohama; Yutaka Matayoshi, Yokosuka, all of Japan

[73] Assignee: Nissan Motor Co., Ltd., Yokohama, Japan

[21] Appl. No.: 523,367

[22] Filed: Aug. 15, 1983

[30] Foreign Application Priority Data

| | | | |
|---|---|---|---|
| Aug. 17, 1982 | [JP] | Japan | 57-142387 |
| Dec. 7, 1982 | [JP] | Japan | 57-215219 |
| Dec. 7, 1982 | [JP] | Japan | 57-215220 |
| Dec. 7, 1982 | [JP] | Japan | 57-215221 |

[51] Int. Cl.[4] ..... F01L 1/34

[52] U.S. Cl. ..... 123/90.16; 123/90.44

[58] Field of Search ..... 123/90.2, 90.16, 90.27, 123/90.39, 90.44

[56] References Cited

U.S. PATENT DOCUMENTS

| | | | |
|---|---|---|---|
| 4,098,239 | 4/1978 | Jarry | 123/90.2 X |
| 4,408,580 | 10/1983 | Kosuda et al. | 123/90.16 |
| 4,414,931 | 11/1983 | Burandt | 123/90.16 |
| 4,438,736 | 3/1984 | Hara et al. | 123/90.16 |

FOREIGN PATENT DOCUMENTS

| | | | |
|---|---|---|---|
| 814808 | 9/1951 | Fed. Rep. of Germany | 123/90.39 |
| 2256091 | 5/1974 | Fed. Rep. of Germany | 123/90.16 |
| 836367 | 1/1939 | France | 123/90.16 |
| 14815 | 2/1981 | Japan | 123/90.16 |

*Primary Examiner*—William R. Cline

*Attorney, Agent, or Firm*—Schwartz, Jeffery, Schwaab, Mack, Blumenthal & Evans

[57] ABSTRACT

An engine valve operating system for an internal combustion engine comprises a rocker arm for transferring valve actuating effect from a driving cam to an engine valve such as an intake or exhaust valve. An elongate lever or fulcrum member is pivoted at its one end section and disposed in fulcrum contact with the side of the rocker arm opposite to the driving cam. Additionally, a hydraulic actuator is provided to control the pivotal location of the lever and therefore has a movable end section which is in contact with the other end section of the lever and movable in accordance with an engine operating condition, thereby greatly improving control response of the lever while rendering unnecessary a large capacity and sized actuator.

28 Claims, 16 Drawing Figures

ENGINE VALVE OPERATING SYSTEM FOR INTERNAL COMBUSTION ENGINE

BACKGROUND OF THE INVENTION

1. Field of the Invention

This invention relates to an engine valve operating system for an internal combustion engine, arranged to control the valve timing and the amount of valve lift of an intake or exhaust valve in accordance with engine operating conditions.

2. Description of the Prior Art

A variety of engine valve operating systems have been heretofore proposed to control the valve timing and the amount of valve lift of intake or exhaust valves of an internal combustion engine. Of these systems, there is one of the type wherein valve actuating effort is transmitted to the intake or exhaust valve through a rocker arm which is in fulcrum contact with a lever or fulcrum member. The fulcrum member is pivotal at its one end and whose pivotal location is controlled by a control cam which is driven in accordance with engine operating conditions.

However, in case where this type engine valve operating system is applied to a multi-cylinder engine having a plurality of the control cams mounted on a single camshaft, a greater torque due to reaction force of a valve spring always acts on the camshaft since any of the intake or exhaust valve makes its lift operation. Rotating the camshaft against the greater torque degrates response of the control cam while requiring a large capacity and sized actuator for the camshaft.

SUMMARY OF THE INVENTION

The engine valve operating system according to the present invention comprises a driving cam rotatable in timed relation to engine revolution. A rocker arm is provided to have a first and section connected to an engine valve such as intake or exhaust valve, and a second end section connected to the driving cam. An elongate lever or fulcrum member is pivoted at its first end section and disposed in fulcrum contact with the side of the rocker arm opposite to the driving cam. Additionally, a hydraulic actuator is provided to control the pivotal location of the lever, and has a movable end section which is in contact with the second end of the lever and movable in accordance with an engine operating condition.

Thus, one hydraulic actuator is used for each lever or fulcrum member and therefore the pivotal location control of the lever can be smoothly accomplished during a time period where the reaction force of a valve spring does not act on the lever, thereby greatly improving the control response of the lever while rendering unnecessary a large capacity and sized actuator.

BRIEF DESCRIPTION OF THE DRAWINGS

The features and advantages of the engine valve operating system according to the present invention will be more clearly appreciated from the following description taken in conjunction with the accompanying drawings in which like reference numerals designate like parts or elements throughout all the embodiments, and in which.

DETAILED DESCRIPTION OF THE INVENTION

Figure 1:
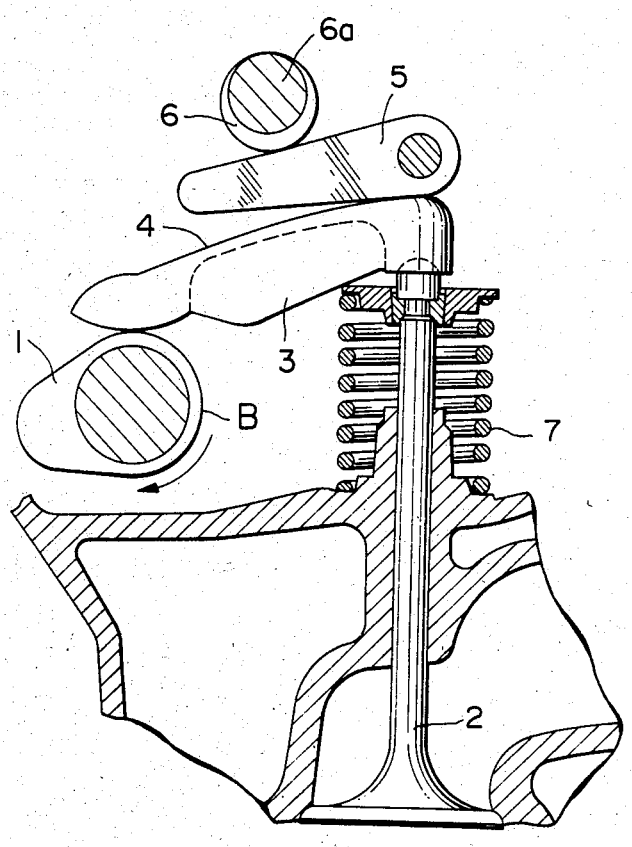
FIG.1 (PRIOR ART)
FIG. 1 is a vertical sectional view of a conventional engine valve operating system.

To facilitate understanding the present invention, a brief reference will be made to an example of a conventional engine valve operating system, depicted in FIG. 1, which is disclosed in U.S. Pat. No. 3,413,965. Referring to FIG. 1, the conventional engine valve operating system is shown having a rocker arm 3 whose one end is in contact with a driving cam 1 while the other end fits to and pivotally supported at the stem end of an intake or exhaust valve 2. The rocker arm 3 is formed curved at its upper surface to form an upper contoured surface 4 which is in fulcrum contact with a lever 5, so that the lifting motion of the cam 1 is transmitted through the rocking rocker arm 3 to the intake or exhaust valve 2. The lever 5 is pivoted at its one end and so arranged that its inclination is controlled by a control cam 6. The control cam 6 is rotated in accordance with an engine operating condition by means of a driving device such as a hydraulic actuator, thus controlling the opening and closing timings and the amount of valve lift of the intake or the exhaust valve 2.

More specifically, for example when the downward movement of the lever 5 under the action of the control cam 6 is larger, the free end section of the lever 5 comes close to the rocker arm 3 in a condition where the rocker arm 3 is in contact with the base circle region B of the driving cam 1, so that the opening timing of the valve 2 becomes earlier increasing the amount of valve lift of the same. When the downward movement of the lever 5 is less, the free end section of the lever 5 and the rocker arm 3 are largely spaced from each other even in same condition of the driving cam base circle region B, so that the opening timings of the valve 2 becomes later decreasing the valve lift amount of the same valve 2.

However, such a conventional engine valve operating system has encountered the following drawbacks: For example in case where it is applied to a multicylinder internal combustion engine having not less than four engine cylinders, either one of intake or exhaust valve is always lifted and therefore a greater torque due to a greater reaction force of a valve spring 7 acts on a camshaft 6*a* of the control cam 6. It is to be noted that a larger sized and capacity actuator is necessary in order to rotate the camshaft 6*a* against the above-mentioned greater torque acting thereon. This further leads to shortcomings, for example, in automotive internal combustion engines, in which it is difficult to dispose such a larger sized actuator in a narrow or limited space; and control response of the control cam 6 becomes inferior. Furthermore, rotating the control cam 6 against the greater torque contributes to power loss while increasing wear of the cam surface of the control cam.

Figure 2:
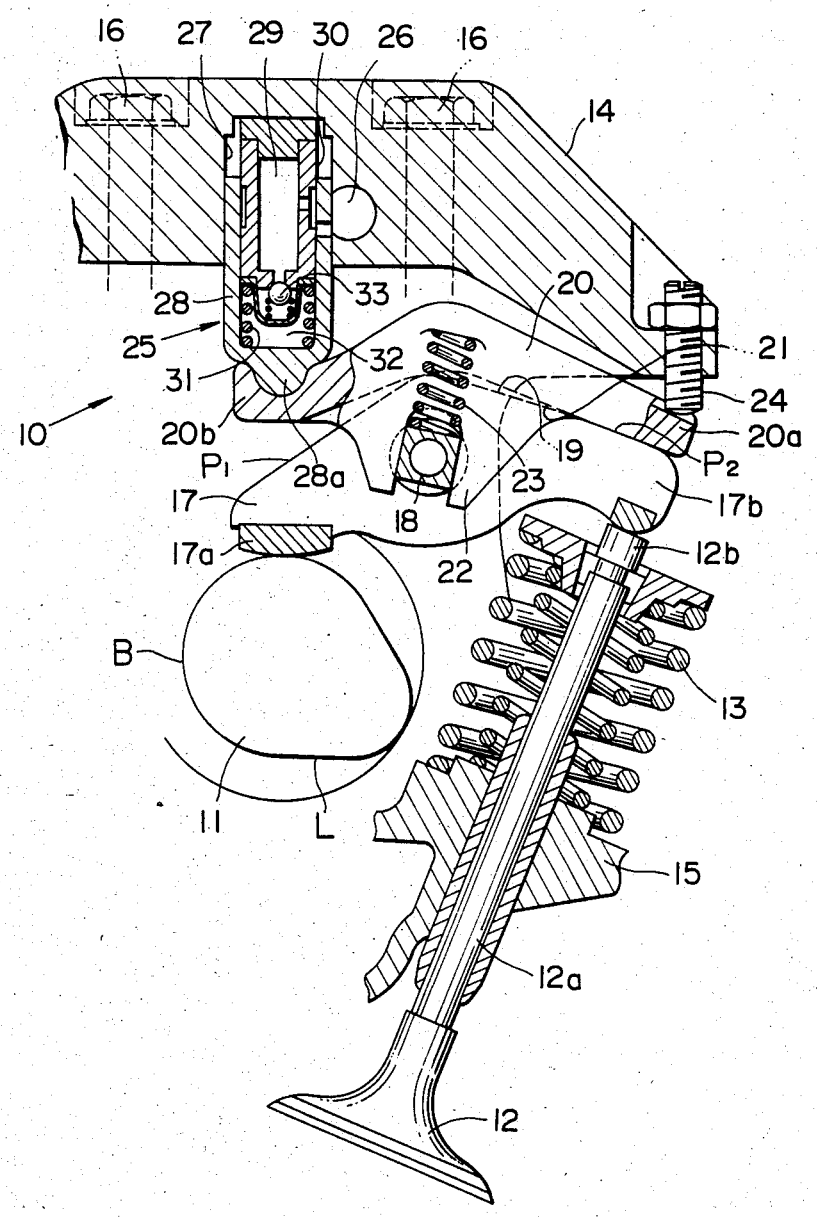
FIG. 2 is a vertical sectional view of a first embodiment of an engine valve operating system in accordance with the present invention.
Figure 3:
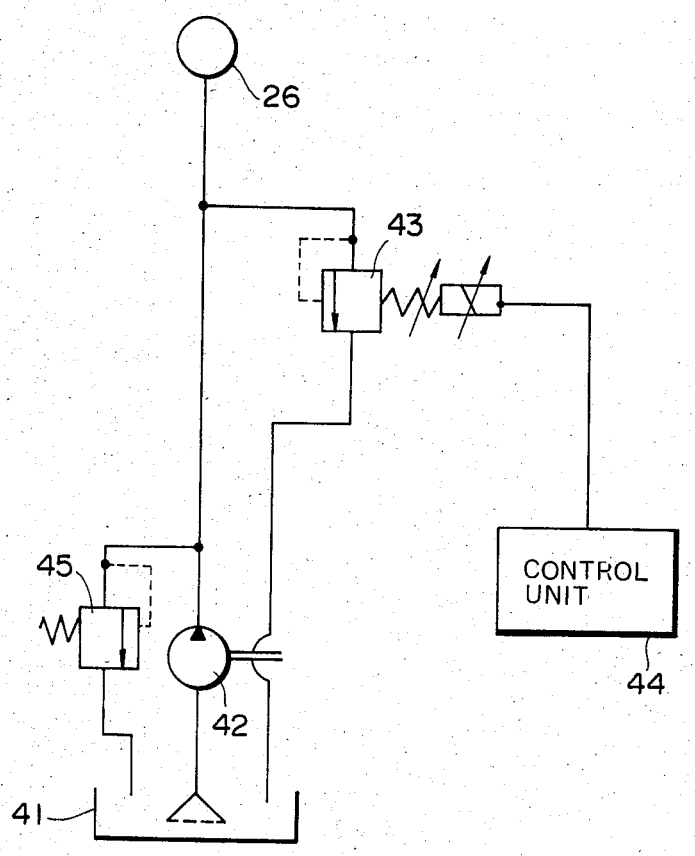
FIG. 3 is a circuit diagram of an example of hydraulic control system for use with the system of FIG. 2.
Figure 4:
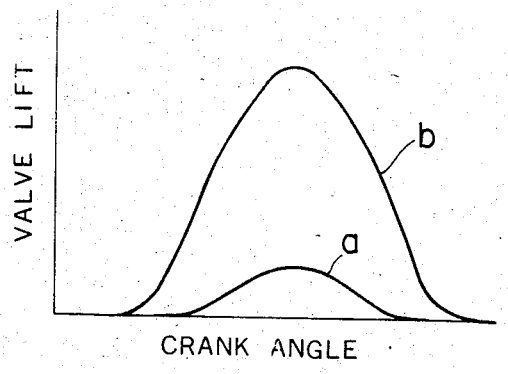
FIG. 4 is a graph showing the valve lift characteristics provided by the system of FIG. 2.

In view of the above description of the conventional engine valve operating system, reference is now made to FIGS. 2 to 4, and more specifically to FIG. 2, wherein a first embodiment of an engine valve operating system of the present invention is illustrated by the reference numeral 10. The engine valve operating system 10, in this embodiment, is for use with an automotive internal combustion engine and comprises an engine valve driving cam 11 which is arranged to rotate in timed relation to engine revolution. The driving cam 11 is operatively connected to an engine valve 12 such as an intake or exhaust valve via a rocker arm 17. A valve spring 13 is provided to urge the valve 12 toward its closed or retracted position. The reference numeral 14 denotes a bracket secured to a cylinder head 15 of the engine by means of bolts 16. The rocker arm 17 contacts at its one end 17*a* with the driving cam 11, and at the other end 17*b* with the stem end 12*b* of a valve stem 12*a* connected to the valve 12. The rocker arm 17 is provided with a support shaft 18. Rocker arm 17 is rotatable relative to the support shaft 18. The support shaft 18 is located generally at the central section of the rocker arm 17. The upper surface 19 of the rocker arm 17 is formed curved to constitute an upper contoured surface having a predetermined profile or contour. In this instance, the upper contoured surface 19 includes first and second generally straight parts $P_1$, $P_2$ which are arranged to form an obtuse angle therewith, leaving a summit portion at a position where the first and second straight parts $P_1$, $P_2$ meet with each other.

A lever or fulcrum member 20 is disposed in fulcrum contact with the rocker arm 17 in a manner that the rocker arm support surface or lower contoured surface 21 thereof contacts with the upper contoured surface 19 at a contact point. The lever 20 is formed at the central section with a bifurcated rocker arm guide section 22 in which the rocker arm support shaft 18 slidably fits. Additionally, a coil spring 23 is disposed in compression between the support shaft 18 and the lever 20 to urge the lever 20 towards the side of the bracket 14. As shown, the lever 20 is pivotally supported at its one end 20*a* located at the side of the valve 12 by an adjustment screw 24 disposed at the tip section of the bracket 14, and further supported at the other end located at the side of the driving cam 11 by an hydraulic actuator 25 which controls the inclination or pivotal position of the lever 20.

The hydraulic actuator 25 is so arranged that the axial length thereof extends and contracts in response to a controlled hydraulic or oil pressure varied in accordance with engine operating condition or conditions. The hydraulic actuator 25 comprises an outer cylindrical member 28 which is slidably disposed in a cylinder barrel or bore 27 formed in the bracket 14 as a hole. The outer cylindrical member 28 is closed at its one or lower end with a bottom part while opened at the other or upper end. The outer cylindrical member bottom part is formed with a generally hemispherical pivot portion 28*a* which pivotally fits in a depression (no numeral) formed at the end section 20*b* of the lever 20. An inner cylindrical member 30 is slidably disposed in the outer cylindrical member 28 and defines thereinside an oil reserving chamber 29 which is always in communication with an oil gallery 26 formed in the bracket 14. As shown, the inner cylindrical member 30 is closed at its upper end. Additionally, a coil spring 31 is disposed in compression between the lower end of the outer cylindrical member 28 and the lower end of the inner cylindrical member 30 to urge the outer cylindrical member 28 towards its extended position where the axial length of the actuator is increased. A hydraulic pressure chamber 32 is defined between the outer cylindrical member lower end and the inner cylindrical member lower end, and is communicable through a check valve 33 with the oil reserving chamber 29.

As shown in FIG. 3, the oil gallery 26 is fluidly connected through an oil pump 42 to an oil reservoir or oil pan 41 so as to be supplied with pressurized engine lubricating oil. The pressure of the oil within the oil gallery 26 is controlled by releasing through an electromagnetic relief valve 43 a part of engine lubricating oil supplied from the oil pump 42. The relief valve 43 is in turn controlled in response to a signal from a control unit 44, which signal depends on engine operating parameters such as engine intake air amount, engine speed, engine temperature. Accordingly, the oil pressure within the oil gallery 26 is controlled in accordance with engine operating condition to provide the controlled oil pressure introduced into the oil reserving chamber 29 of the actuator 25. Additionally, a relief valve 45 is provided to prevent an excessive pressure rise in a line leading to the oil gallery 26.

The manner of operation of the engine valve operating system 10 will now be discussed hereinafter.

When the controlled oil pressure introduced from the oil gallery 26 into the hydraulic actuator 25 is relatively low or lower a predetermined level, the outer cylindrical member 28 of the actuator 25 is pushed up in the drawing under the action of the bias of the spring 23, so that the axial overall length of the actuator becomes shorter. Consequently, the lever 20 pivoted by the adjustment screw 24 makes its swinging or rocking motion at a higher location where the lever 20 is spaced from the upper contoured surface 19 of the rocker arm 17 when the rocker arm end section 17*a* is in contact with the base circle region B of the driving cam 11. Accordingly, when the lift of the driving cam 11 is initiated from this state, the opening timing of the valve 12 is delayed by a predetermined time period relative to the rising timing of the driving cam 11 at which timing the rocker arm end section 17*a* begins to be brought into contact with the cam lobe region L of the driving cam 11, and additionally the closing timing of the valve 12 becomes early by a predetermined time period relative to the rising timing of the driving cam 11, thereby rendering smaller the maximum valve lift amount of the valve 12, as indicated by a line a in FIG. 4. In this state, as the rocker arm 17 lifts or moves upwardly in the drawing, rotating force in the clockwise direction in the drawing is imparted to the lever 20. However, the oil pressure within the oil pressure chamber 32 of the hydraulic actuator 25 is maintained as it is under the action of the check valve 33. As a result, the overall length of actuator 25 scarecely changes, thereby maintaining the inclination of the lever 20 as it is.

Subsequently, when the controlled oil pressure supplied to the hydraulic actuator 25 becomes high or higher than a predetermined level in response to engine operating condition, the outer cylindrical member 28 of the actuator 25 projects downwardly in the drawing until the resultant force of composition of the controlled oil pressure and the force due to the coil spring 31 is balanced with the reaction force of the coil spring 23, during a time period in which the reaction force of the valve spring 13 does not act on the lever 20, i.e., the rocker arm 17 is in contact with the base circle region B of the driving cam 11. As a result, the lever 20 is rotated counterclockwise in the drawing, thereby creating a state where the rocker arm upper contoured surface 19 and the lever lower contoured surface 21 come near each other. Accordingly, when the lift of the driving cam 11 is initiated from this state, the valve 12 opens and closes generally at the same timings respectively as the driving cam rising and falling modes, thereby rendering larger the maximum valve lift amount, as indicated by a line b in FIG. 4. At the driving cam rising mode, the rocker arm end section **17*a* is brought into contact with the cam lobe region L of the driving cam 11. At the driving cam falling mode, the rocker arm end section 17*a* is brought into contact with the base circle region B of the driving cam 11. During the lift operation of the valve 12, the inclination of the lever 20 is of course maintained as it is under the action of the check valve 33 in the hydraulic actuator 25**.

The hydraulic actuator 25 is so configurated that a slight amount of oil within the oil pressure chamber 32 leaks, for example, through a clearance between the outer cylindrical member 28 and the cylinder barrel 27 at each lift of the driving cam 11, and a required amount of oil is supplemented from the oil reserving chamber 29 to the oil pressure chamber 32 at the termination of the lifting mode of the driving cam 11, thus providing a suitable overall length of the hydraulic actuator in accordance with the controlled oil pressure supplied to the hydraulic actuator 25.

As will be appreciated from the above, according to the arrangement in which the hydraulic actuator 25 is used for each lever or fulcrum member 20, the inclination of the lever 20 can be smoothly controlled during the time period in which the reaction force of the valve spring 13 does not act on the lever 20, and therefore a much smaller driving force is required for the hydraulic actuator 25. In this regard, it is unnecessary to provide a large capacity and sized hydraulic system. Additionally, power loss can be sharply reduced while greatly improving the response of the lever 20 upon changing in the controlled oil pressure. Furthermore, the lever 20 is prevented from wear, thereby prolonging the life thereof. It will be understood that a valve clearance necessary for dealing with heat expansion and the like is easily adjustable by screwing in or out the adjustment screw 24 which pivotally supports the one end **20*a* of the lever 20**.

Figure 5:
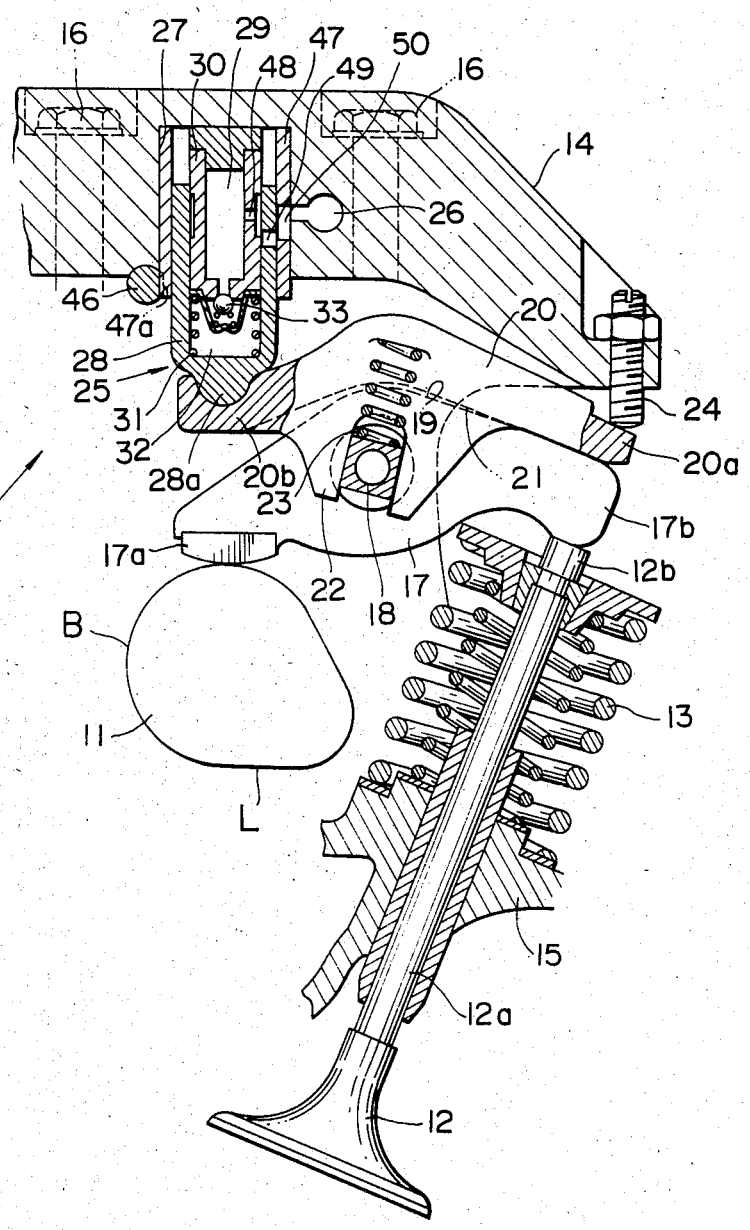
FIG. 5 is a vertical sectional view of a second embodiment of the engine valve operating system in accordance with the present invention.

FIG. 5 illustrates a second embodiment of the engine valve operating system having an arrangement similar to that shown in FIG. 2, except for the construction of the hydraulic actuator 25. In this embodiment, the hydraulic actuator 25 is so configurated that its overall length varies in synchronism with the movement of a control rack 46 which is driven in accordance with engine operating condition or conditions.

The hydraulic actuator 25 comprises a control sleeve or cylindrical member 47 which rotatably fits in the cylinder barrel 27 and formed at its lower part with a pinion portion **47*a* engaged with the control rack 46. The outer cylindrical member 28 is axially slidably disposed in the control sleeve 27. As shown, the oil reserving chamber 29 is communicable with the oil gallery 26 through oil holes 48, 49, and an oil pressure supply passage 50 or control window. The oil holes 48, 49 are formed through the cylindrical side walls of the inner and outer cylindrical members 30, 28, respectively, and always communicate with each other. The oil pressure supply passage 50 is formed through the cylindrical side wall of the control sleeve 47 and extends generally in the peripheral direction of the control sleeve 47. The oil pressure supply passage 50 is formed in a manner to controllably restrict the communication between the oil hole 49 of the outer cylindrical member 28 and the oil gallery 26**.

Figure 6:
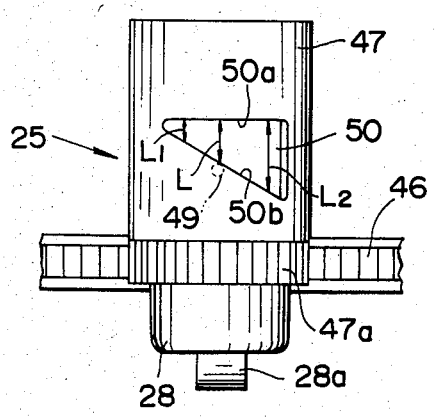
FIG. 6 is a side view of an essential part of the system of FIG. 5.
Figure 7:
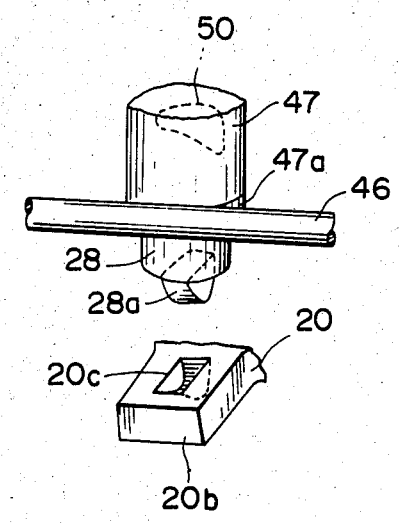
FIG. 7 is a perspective view of the essential part of FIG. 6.

As shown in FIG. 6, the oil pressure supply passage 50 has upper end and lower edges **50*a*, 50*b* which are respectively located on the side of the upper or base end and on the side of the lower or tip end of the control sleeve 47. The upper end edge 50*a* extends in the peripheral direction of the control sleeve 47, and its location in the axial direction is constant along the peripheral direction of the control sleeve 47. The lower end edge 50*b* extends to be inclined relative to the peripheral direction, and its location in the axial direction of the control sleeve 47 varies along the peripheral direction of the control sleeve 47. Accordingly, the oil pressure supply passage 50 is generally in the triangular shape. It will be understood that the lower end edge 50*b* of the oil pressure supply passage 50 provides a communicable limit between the oil pressure supply passage 50 and the outer cylindrical member oil hole 49, with respect to the projection of the outer cylindrical member 28. As seen from the above, the projectable stroke L of the outer cylindrical member 28 varies in accordance with the rotational location of the control sleeve 47 controllably driven by the control rack 46. It is to be appreciated that the upper end edge 50*a* of the oil pressure supply passage 50 may be modified into any suitable shape, for example, formed parallel with the lower end periphery 50*b* in case where the passage 50 is always in communication with the oil gallery 26. Additionally, as shown in FIG. 7, the pivot portion 28*a* of the outer cylindrical member 28 and the depression 20*c* formed in the lever end section 20*b* are so shaped as to prevent the rotation of the outer cylindrical member 28**.

Figure 8:
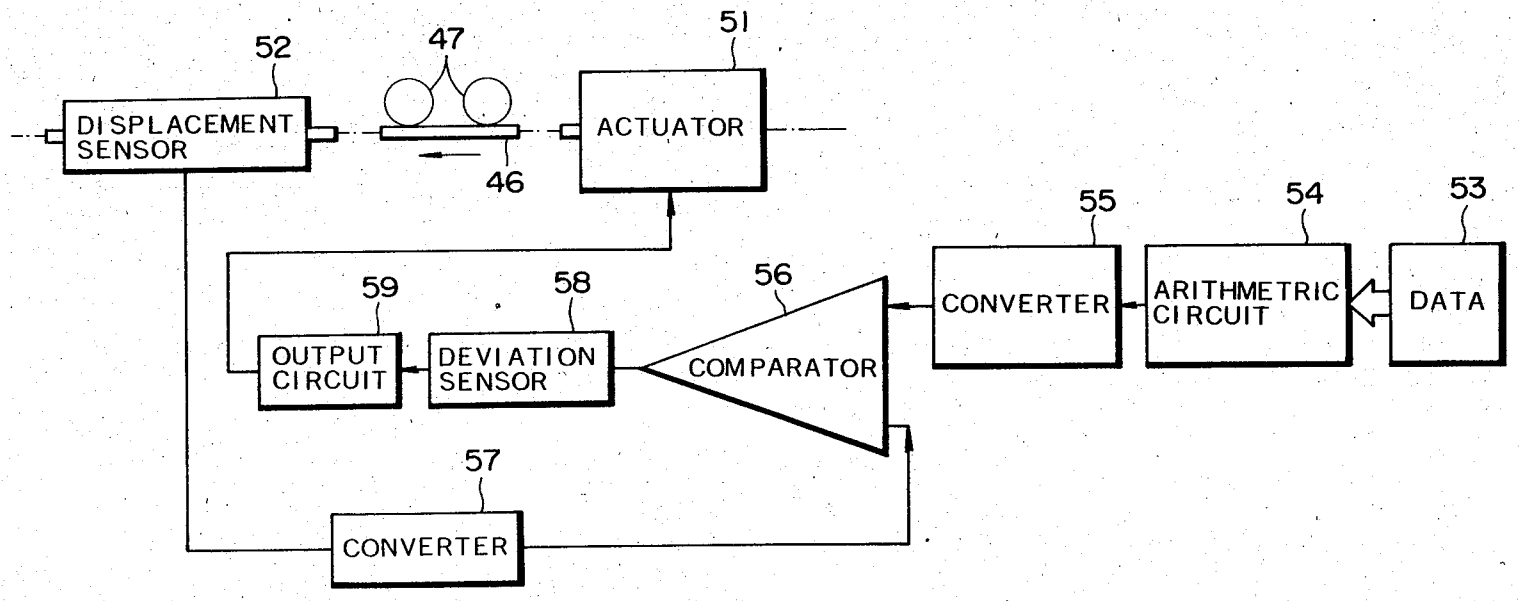
FIG. 8 is a block diagram showing a control circuit for a control rack used in the system of FIG. 5.

As shown in FIG. 8, the control rack 46 is arranged to cause a plurality of the control sleeves 47 to operate simultaneously, and driven forward and backward by a suitable actuator 51 such as a linear motor or a hydraulic cylinder, in which the movlng amount of the control rack 46 is detected by a displacement detector 52 such as a potentiometer and feedback controlled to a predetermined value. More specifically, a control command signal is produced by an arithmetic circuit 55 and a control value determination output converter 54 in dependence on data 53 of the various engine operating parameters such as intake vacuum, engine speed, and engine coolant temperature. The control command signal is supplied to a comparator 56 and compared with a signal fed through a converter 57 from the displacement sensor 52, so that a deviation signal in accordance with the deviation between the former and latter signals is then fed from a deviation sensor 58 to an output circuit 59. Consequently, an actuator 51 is driven through the output circuit 59 in dependence on the deviation signal, thus controlling the position of the control rack 46 in the forward and backward directions.

In operation, first referring to FIG. 6, when the control rack 46 is controlled to a condition to move leftward in the drawing, the communicable limit for the oil hole 49 or the axial direction location of the lower end periphery of the oil pressure supply passage or control window 50 moves upward in the drawing under the relative rotation between the control sleeve 47 and the outer cylindrical member 28, so that the projectable stroke L of the outer cylindrical member 28 is reduced to a value of $L_1$. More specifically, the outer cylindrical member 28 projects under the bias of the coil spring 31 with the result that the oil pressure chamber 32 is supplied with oil from the oil gallery 26, in which the supply of oil to the oil pressure chamber 32 is stopped at a time point where the oil hole 49 is closed by the lower end edge **50*b* of the oil pressure supply passage 50, thereby preventing the outer cylindrical member 28 from further projecting. Accordingly, the overall length of the hydraulic actuator 25 is shortened in accordance with the above-mentioned stroke $L_1$ by allowing oil within the oil pressure chamber 32 to leak, for example though a clearance between the outer and inner cylindrical members 28, 30**.

Consequently, the lever 20 pivoted by the adjustment screw 24 makes its swinging or locking motion at a higher location in which the lever 20 is spaced from the upper contoured surface 19 of the rocker arm 17 when the rocker arm end section **17*a* is in contact with the base circle region B of the driving cam 11. Accordingly, when the lift of the driving cam 11 is initiated from this state, the opening timing of the valve 12 is delayed by a predetermined time period relative to the rising timing of the driving cam 11 at which timing the rocker arm end section 17*a* begins to be brought into contact with the cam lobe region L of the driving cam 11, and additionally the closing timing of the valve 12 becomes early by a predetermined time period relative to the rising timing of the driving cam 11, thereby rendering smaller the maximum valve lift amount of the valve 12, as indicated by a line a in FIG. 4. In this state, as the rocker arm 17 lifts or moves upwardly in the drawing, rotating force in the clockwise direction in the drawing is imparted to the lever 20. However, the oil pressure within the oil pressure chamber 32 of the hydraulic actuator 25 is maintained as it is under the action of the check valve 33. As a result, the overall length of actuator 25 scarecely changes, thereby maintaining the inclination of the lever 20** as it is.

Thus, the hydraulic actuator 25 is arranged to repeat, during engine running, an operation in which oil within the oil pressure chamber 32 leaks in a slight amount through a clearance between the outer cylindrical member 28 and the control sleeve 47 at each lift of the driving cam 11, and a required amount of oil is supplied from the oil gallery 26 through the oil reserving chamber 29 to the oil pressure chamber 32 at the timing of lift termination of the driving cam 11. Accordingly, the projection amount of the outer cylindrical member 28 is determined to such a level that roughly the upper edge of the oil hole 49 is always located slightly above the lower end edge **50*b* of the oil pressure supply passage 50, i.e., the amount of leaked oil is balanced with that of supplemented oil. Therefore, the overall length of the hydraulic actuator 25 can be always accurately controlled in accordance with the rotational position of the control sleeve 47**.

Subsequently, the control rack 46 is moved rightward in FIG. 6 in accordance with engine operating conditions, the hydraulic actuator 25 so operates that the projectable stroke L of the outer cylindrical member 28 increases to a value indicated by $L_2$. Accordingly, the overall length of the hydraulic actuator 25 increases in response to the projectable stroke $L_2$ during a time period in which the reaction force of the valve spring 13 does not act on the lever 20, i.e., the rocker arm 17 is in contact with the base circle region B of the driving cam 11. As a result, the lever 20 rotates counterclockwise in the drawing, thereby creating a state where the rocker arm upper contoured surface 19 and the lever lower contoured surface 21 come near each other. Accordingly, when the lift of the driving cam 11 is initiated from this state, the valve 12 opens and closed at generally the same timings respectively as the driving cam rising and falling modes, thereby rendering larger the maximum valve lift amount, as indicated by a line b in FIG. 4. At the driving cam rising mode, the rocker arm end section **17*a* is brought into contact the cam lobe resion L of the driving cam 11. At the driving cam falling mode, the rocker arm end section 17*a* is brought into contact with the base circle region B of the driving cam 11. During the lift operation of the valve 12, the inclination of the lever 20 is of course maintained as it is under the action of the check valve 33 in the hydraulic actuator 25**.

As seen from the above, when the control rack 46 is again moved leftward in the state where the hydraulic actuator 25 has extended, the hydraulic actuator 25 is gradually shortened under the action of oil leaking at each cam lift. In this regard, it will be understood that such shortening of the hydraulic actuator 25 can sufficiently follow even an abrupt change in the control rack moving direction during several times of cam lifts, by setting oil leaking amount to a suitable value.

As will be appreciated from the above, according to the embodiment of FIGS. 5 to 8, the projectable amount of the outer cylindrical member of the hydraulic actuator can be controlled in a high accuracy by means of the control rack, and therefore such a control is not affected, for example, by the viscosity of engine lubricating oil while uniformly operating a plurality of hydraulic actuators in a multi-cylinder internal combustion engine.

Figure 9:
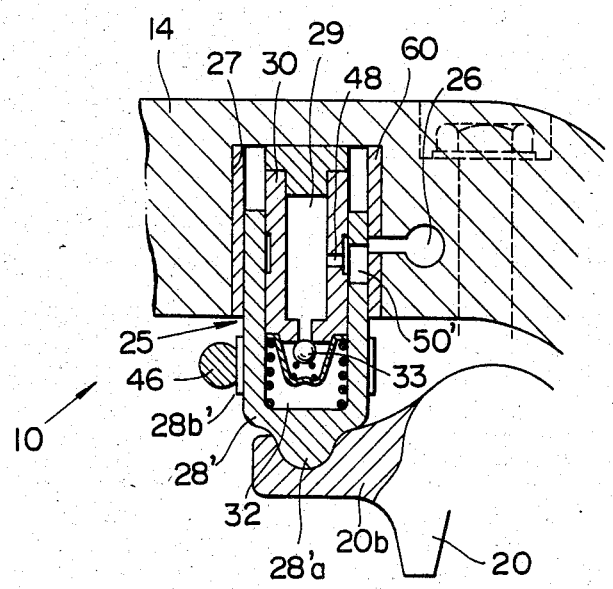
FIG. 9 is a vertical sectional view of a part of a third embodiment of the engine valve operating system in accordance with the present invention.
Figure 10:
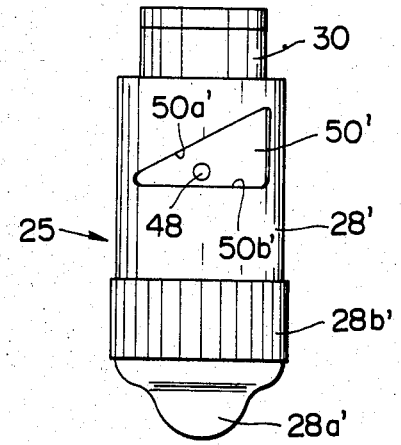
FIG. 10 is a side view of an essential part of the system of FIG. 9.

FIG. 9 illustrates a third embodiment of the engine valve operating system in accordance with the present invention, which is similar to the second embodiment of FIGS. 5 to 8. In this embodiment, an outer cylindrical member 28' serves as a control sleeve, and therefore is formed with a pinion portion **28*b*' which is in engagement with the control rack 46. The outer cylindrical member 28' is formed at its cylindrical side wall with an oil pressure supply passage or control window 50', and slidably disposed in a cylindrical sleeve member 60 secured to the cylinder barrel 27 of the bracket 14. Additionally, the inner cylindrical member 30** is slidably disposed in the outer cylindrical member or control sleeve 28'. The outer cylindrical member 28' has a pivot portion 28a' which pivotally fits to the lever end section 20b. The oil pressure supply passage or control window 50' of the outer cylindrical member 28' is so formed as to always communicate with the oil hole 48 of the inner cylindrical member 30 while changing the communicable limit with the oil gallery 26 in accordance with the rotation of the outer cylindrical member or control sleeve 28'. Accordingly, the oil pressure supply passage 50' is shaped as shown in FIG. 10 where the upper end edge 50a' is inclined relative to the peripheral direction of the outer cylindrical member 28' and the lower end edge 50b' is parallel with the same peripheral direction as being contrary to in the second embodiment shown in FIG. 6. It will be therefore understood that, also in this embodiment, the inclination or pivotal location of the lever 20 can be precisely controlled in accordance with the position of the control rack 46.

While the cylindrical sleeve 60 of the independent type has been shown and described as being secured to the cylinder barrel 27 of the bracket 14, it will be understood that the sleeve 60 may be omitted so that the outer cylindrical member 28' is directly in slidable contact with the surface of the bracket cylinder barrel 27.

Figures 11, 12:
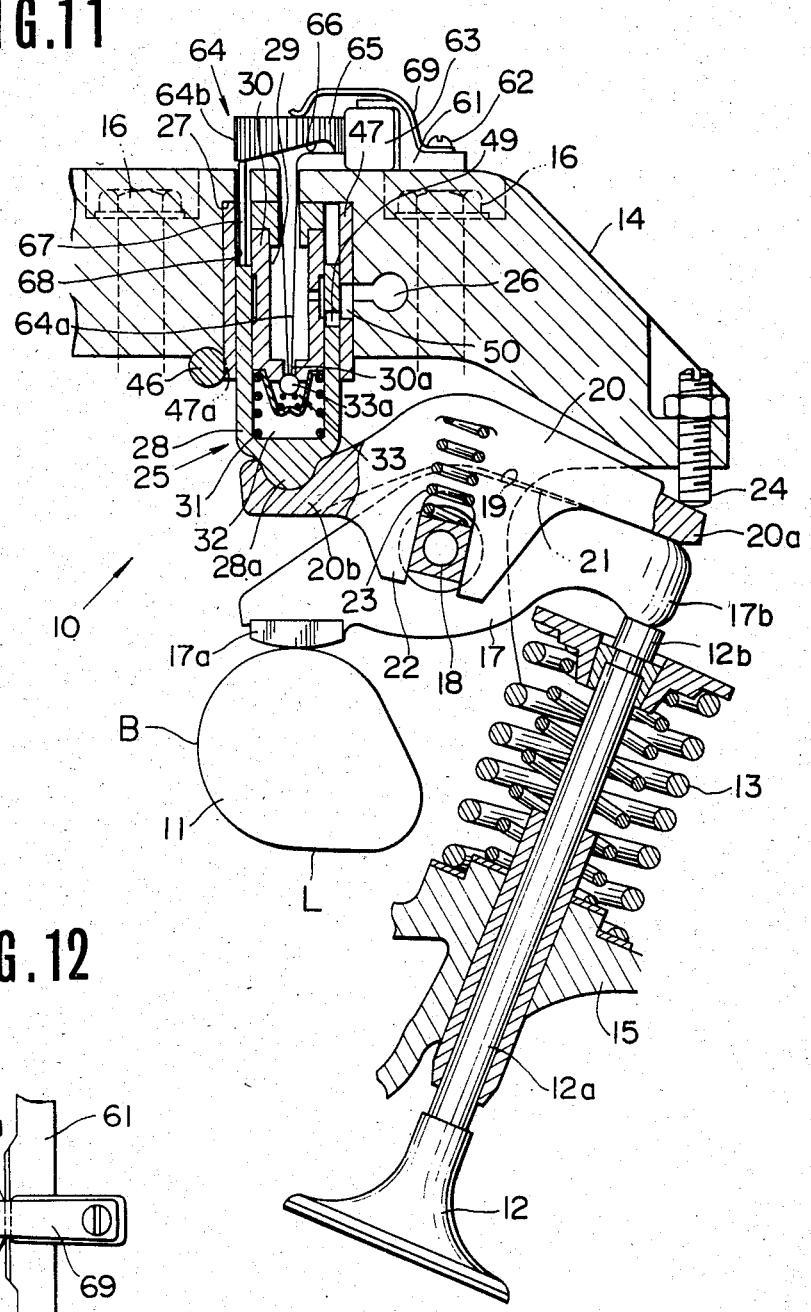
FIG. 11 is a vertical sectional view of a fourth embodiment of the engine valve operating system in accordance with the present invention.
FIG. 12 is a plan view of an essential part of the system of FIG. 11.

FIG. 11 illustrates a fourth embodiment of the engine valve operating system in accordance with the present invention, which is similar to the second embodiment shown in FIGS. 5 to 8 except for an oil leakage control device for controlling oil leakage from the oil pressure chamber 32 to the oil reserving chamber 29 through the check valve 33.

The oil leakage control device comprises an operating member 64 including a needle section 64a which is integral with and perpendicularly extends from the bottom central section of a disc section 64b toward the check valve 33. The disc section 64b is formed at its periphery with a pinion portion 65 which is in engagement with a rod-like control rack 63. The control rack 63 is slidably disposed in a guide member 61 having a L-shaped section defining a depression receiving the control rack 63 in cooperation with the upper surface of the bracket 14. The guide member 61 is fixed to the bracket 14 by means of a screw 62. The disc section 64 is formed along its bottom periphery with a cam portion 66. The needle section 64a extends downwardly through an opening (no numeral) of the bracket 14 and reaches the oil reserving chamber 29. The tip end of the needle section 64a is so positioned as to be in close proximity to or in light contact with the surface of the ball 33a of the check valve 33. The check valve ball 33a is urged toward its position to close an oil flowing hole 30a formed through the bottom end of the inner cylindrical member 30, under the bias of a spring (no numeral). The reference numeral 67 denotes a connecting member movably disposed in a guide hole 68 formed through the bracket 14. The connecting member 67 is contacted at its upper end with the cam contour of the disc section cam portion 66, and at its lower end with the upper end surface of the outer cylindrical member 28. Indicated by the reference numeral 69 is an arcute leaf or plate spring whose end is secured on the guide member 61. The other end of the spring 69 is in press contact with the top central portion of the operating member disc section 64b so as to urge the operating member 64 downward in FIG. 11. The plan view showing the spring 69 and its vicinity is revealed in FIG. 12.

In operation of the thus arranged oil leakage control device in the engine valve operating system 10, when the engine is cold such as in low ambient temperature condition or during engine starting, the control rack 63 slidably moves in accordance with data representing various engine operating parameters such as engine speed, throttle opening position, intake air amount, engine coolant temperature, and intake or exhaust valve lift amount, thus rotating the operating member 64 whose disc section 64b engages with the control rack 63. This moves the contact point of the connecting member 67 with the operating member disc section cam portion 66 from a higher contoured part to a lower contoured part, i.e., from the left side to the right side of the cam portion 66 in FIG. 11. As a result, the operating member gradually descends so that the tip end of the needle section 64a causes the check valve 33 to open.

Thus, the check valve 33 is compulsorily opened in cold condition of the engine, so that oil in the oil pressure chamber 32 is restored to the oil reserving chamber 29. At this time, the outer cylindrical member 28 is rapidly displaced in contraction direction of the hydraulic actuator 25 by an amount corresponding to an oil amount restored from the oil pressure chamber 32 to the oil reserving chamber 29. This raises the operating member 64 through the connecting member 67, thereby stopping the opening operation of the check valve 33 by the operating member 64.

Accordingly, control response at a transition from a larger valve lift control to a smaller valve lift control is effectively improved particularly even when the viscosity of oil is higher as in cold engine condition where the amount of oil leaking through the clearance between the outer and outer cylindrical members 28, 30 decreases. Thus, the oil leakage control device can provide higher contraction speed of the outer cylindrical member 28 in response to the engine operating condition.

While the thus arranged oil leakage control device has been shown and described as being applied to the hydraulic actuator 25 of the type wherein the oil pressure introduced thereinto is controlled by the control sleeve 47, it will be understood that the oil leakage control device is applicable to the hydraulic actuators of other types, for example, of the type wherein oil pressure supplied to the oil reserving chamber 29 is controlled directly in accordance with engine operating conditions, and therefore applicable to the hydraulic actuator of the type shown in FIG. 2.

Figure 13:
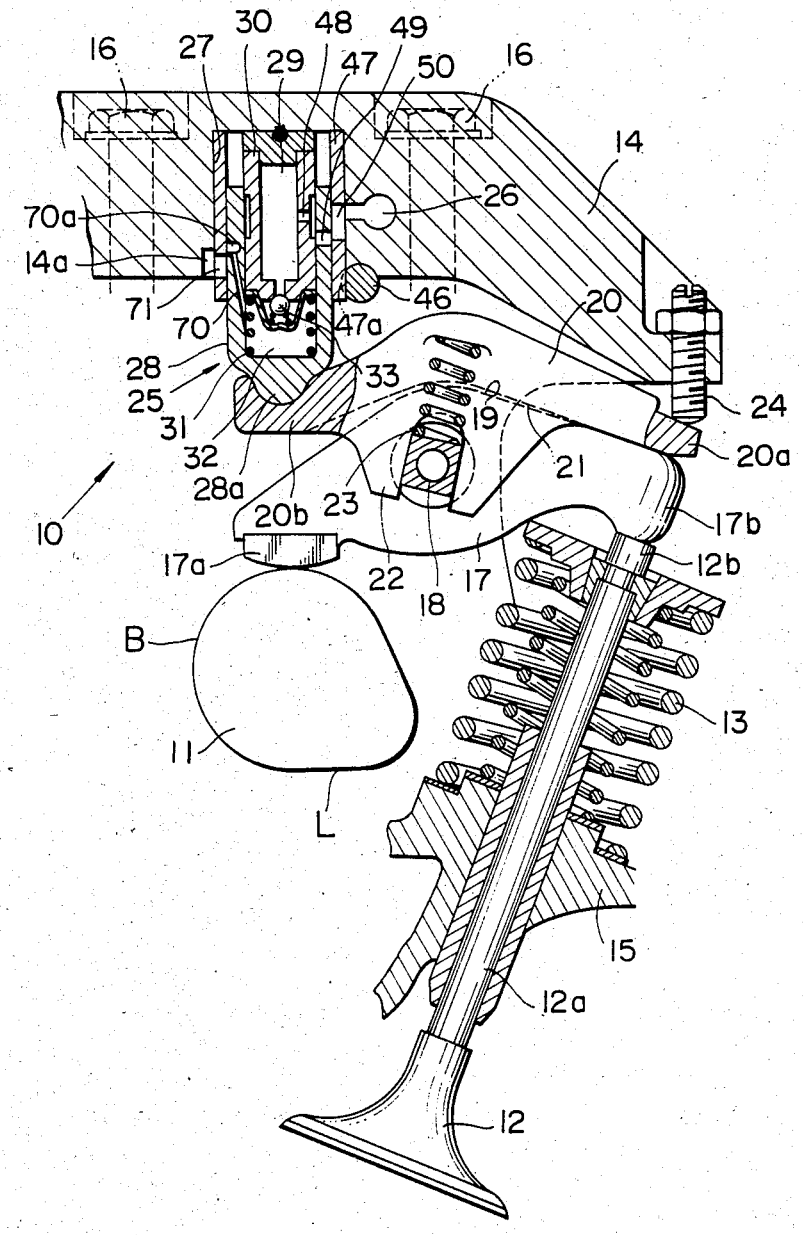
FIG. 13 is a vertical sectional view of a fifth embodiment of the engine valve operating system in accordance with the present invention.

FIG. 13 illustrates a fifth embodiment of the engine valve operating system according to the present invention, which is similar to the second embodiment of FIG. 5 except for an oil leakage control arrangement for controlling oil leakage from the oil pressure chamber 32 to the outside of the hydraulic actuator 25.

In this embodiment, the outer cylindrical member 28 is formed with an oil leakage passage 70 forming part of the oil leakage control arrangement. The oil leakage passage 70 is formed passing through the cylindrical side wall of the outer cylindrical member 28 in a manner that its lower end is always opened to the oil pressure chamber 32 while the upper end is openable through an enlarged end portion 70a to a control through-hole 71 formed through the cylindrical wall of the control sleeve 47. The through-hole 71 is in communication with the outside of the hydraulic actuator 25 through a cutout portion 14a of the bracket 14.

Figure 14A:
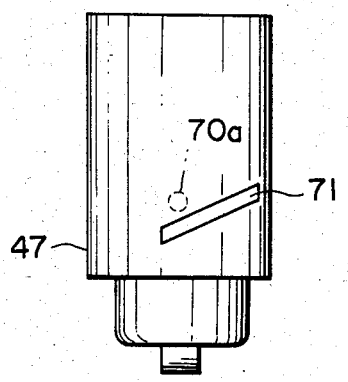
FIGS. 14A to 14C are schematic illustrations showing the locational relationship between an oil leakage passage of an outer cylindrical member and a control through-hole of a control sleeve in the system of FIG. 13.
Figure 14B:
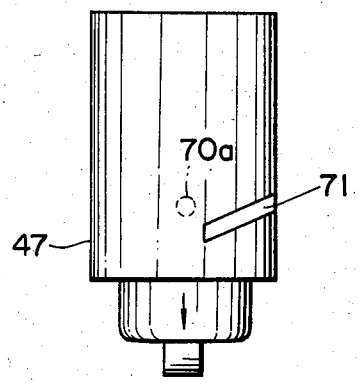
Figure 14C:
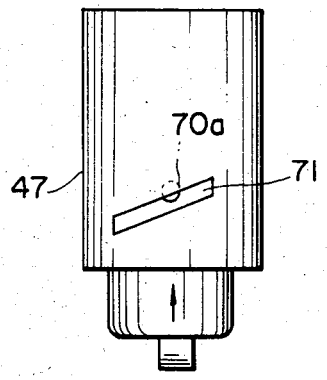

As shown in FIG. 14A to 14C, the through-hole 71 elongates along the peripheral surface of the control sleeve 47 and inclined relative to an imaginary plane to which the axis of the control sleeve 47 is perpendicular. The through-hole 71 has a constant width along the axis thereof, and so arranged that the communication between it and the oil pressure chamber 32 through the oil leakage passage 70 is established or blocked in accordance with the rotational direction of the control sleeve 47. More specifically, in order to project the outer cylindrical member 28 to enlarge valve lift, the control sleeve 47 is rotated in one direction so that oil is supplied from the oil pressure supply passage or control window 50 to the oil reserving chamber 29 and the oil pressure chamber 32 through the oil holes 49, 48. At this time, the through-hole 71 is located rightward relative to the oil leakage passage enlarged portion 70*a* as shown in FIG. 14B and consequently does not open to the oil leakage passage 70, thus confining oil within the oil pressure chamber 32. On the contrary, in order to retract the outer cylindrical member 28 to reduce valve lift, the control sleeve 47 is rotated in an opposite direction so that oil supply to the oil reserving chamber 29 and the oil pressure chamber 32 is stopped. At this time, the through-hole 71 of the control sleeve 47 is brought into communication with the oil leakage passage 70 as shown in FIG. 14C. As a result, oil within the oil pressure chamber 32 abruptly flows out of the hydraulic actuator 25, thereby effectively improving the response in contraction of the hydraulic actuator during a valve lift reducing operation.

The oil leakage control arrangement operates as follows: In case where valve lift reduces after it has been enlarged, when the valve lift is reduced sharply from a larger value to a smaller value, the communication between the oil pressure supply passage 50 and the oil hole 49 is blocked by the rotation of the control sleeve 47 while the throughhole 71 is brought into communication with the enlarged end portion 70*a* of the oil leakage passage 70, thus causing oil within the oil pressure chamber 32 to leak out of the hydraulic actuator 25. As a result, the outer cylindrical member 28 is rapidly retracted to shorten the overall length of the hydraulic actuator 25 under the action of each lift of the driving cam 11 in which the above-mentioned oil leakage is made through the oil leakage passage 70, thereby greatly improving response in control of the hydraulic actuator 25. In this case, when valve lift is smaller, oil within the oil pressure chamber 32 leaks, for example into the oil reserving chamber 29 through the clearance between the control sleeve 47 and the outer cylindrical member 28, so that oil leak amount becomes less and therefore valve lift is prevented from being largely reduced. With this oil leakage control arrangement, the engine valve operating system 10 is effectively prevented from control error due to, for example, change in the viscosity of oil.

While a meshing mechanism including the control rack has been shown and described as means for driving the control sleeve of the hydraulic actuator, it will be appreciated that the meshing mechanism may be replaced with other driving mechanisms, for example, a link mechanism, and a wrapping connector mechanism including rope or belt.

As many apprently widely different embodiments of this invention may be made without departing from the spirit and scope thereof, it is to be understood that the invention is not limited to the specific embodiments thereof except as defined in the appended claims.

What is claimed is:

1. An engine valve operating system for an internal combustion engine, comprising:

a driving cam rotatable in timed relation to engine revolution;

a rocker arm having a first end section drivingly connected to an engine valve and a second end section drivably connected to said driving cam;

an elongated lever pivoted at a first end section and disposed in fulcrum contact with said rocker arm;

means for biasing said rocker arm and said lever away from each other; and a hydraulic actuator having a movable end section which is in contact with a second end section of said lever and movable to control the pivotal location of said lever in accordance with an engine operating condition, thereby controlling the orientation of said fulcrum contact between said rocker arm and said lever, said hydraulic actuator including an outer cylindrical member slidably disposed in a cylinder barrel formed in a fixed member, said outer cylindrical member being connected to the second end section of said lever and movable in a first direction to cause said elongated lever second end section and said rocker arm second end section to approach each other and in a second direction to allow said elongated lever second end section and said rocker arm second end section to separate from each other, an inner cylindrical member slidably disposed in said outer cylindrical member and defining thereinside an oil reserving chamber to be filled with oil, means for controlling said oil in response to the engine operating condition, an oil pressure chamber being defined between said inner and outer cylindrical members, and a check valve disposed between said oil reserving chamber and said oil pressure chamber to prevent oil flow from said oil pressure chamber to said oil reserving chamber.

2. An engine valve operating system as claimed in claim 1, said rocker arm is formed with an upper contoured surface while said lever is formed with a lower contoured surface, the upper and lower contoured surfaces being in fulcrum contact with each other.

3. An engine valve operating system as claimed in claim 1, said biasing means includes a spring interposed between said rocker arm and said lever to bias them in the direction that the lower and upper contoured surfaces of said rocker arm and lever are spaced apart from each other.

4. An engine valve operating system as claimed in claim 3, further comprising a rotatable shaft which is rotatably disposed through said rocker arm.

5. An engine valve operating system as claimed in claim 4, wherein said lever is formed with a bifurcate support section which slidably fits with said rotatable shaft.

6. An engine valve operating system as claimed in claim 4, wherein said spring is interposed between said rotatable shaft and a portion of said lever.

7. An engine valve operating system as claimed in claim 2, further comprising an adjustment screw disposed in a bracket secured to a cylinder head of the engine, said adjustment screw being in contact with the first end section of said lever to adjust the pivot point of said lever.

8. An engine valve operating system as claimed in claim 1, wherein said oil reserving chamber is always communicated with an oil pressure source whose oil pressure is controlled in response to the engine operating condition.

9. An engine valve operating system as claimed in claim 8, further comprising means for controlling the oil pressure within said oil pressure source in accordance with the engine operating condition.

10. An engine valve operating system as claimed in claim 9, wherein said oil pressure controlling means includes a relief valve operatively connected to said oil pressure source, and a control circuit operatively connected to said relief valve so as to control said relief valve in accordance with the engine operating condition.

11. An engine valve operating system as claimed in claim 8, wherein said coil spring urges said outer cylindrical member towards said lever.

12. An engine valve operating system as claimed in claim 11, wherein said check valve is arranged to prevent oil flow from said oil pressure chamber to said oil reserving chamber.

13. An engine valve operating system as claimed in claim 1, wherein said hydraulic actuator includes:

a cylindrical control sleeve rotatably disposed in a cylinder barrel formed in a fixed member, said control sleeve being driven by a control rack which is movable in accordance with the engine operating condition, said outer cylindrical member slidably disposed in said control sleeve and being formed at its cylindrical wall with a through-hole; and means defining a control window formed through the cylindrical wall of said control sleeve, through which control window said outer cylindrical member through-hole is communicable with said oil pressure source, said control window elongating generally along the peripheral direction of said control sleeve and having a control edge forming part of the periphery of said control window, the location of said control edge in the axial direction of said control sleeve changing along the peripheral direction of said control sleeve so as to control the communication between said outer cylindrical member through-hole and said oil pressure source with respect to the movement of said outer cylindrical member toward said lever second end section.

14. An engine valve operating system as claimed in claim 13, wherein said control edge of said control window is arranged such that a first plane containing said control edge is inclined relative to a second plane to which the axis of said control sleeve is perpendicular.

15. An engine valve operating system as claimed claim 13, further comprising means for preventing the rotation of said outer cylindrical member in its peripheral direction.

16. An engine valve operating system as claimed in claim 15, wherein said control sleeve is formed at the outer cylindrical surface with a pinion portion in engagement with said control rack.

17. An engine valve operating system as claimed in claim 1, wherein said outer cylindrical member is rotatable along its peripheral direction and driven by a control rack which is movable in accordance with the engine operating condition, in which said oil reserving chamber is communicable with an oil pressure source through a through-hole formed at the cylindrical wall of said inner cylindrical member, in which said hydraulic actuator includes:

means defining a control window formed through the cylindrical wall of said control sleeve, through which control window said inner cylindrical member through-hole is communicable with said oil pressure source, said control window elongating generally along the peripheral direction of said control sleeve and having a control edge forming part of the periphery of said control window, the location of said control edge in the axial direction of the control sleeve changing along the peripheral direction of said control sleeve so as to control the communication between said inner cylindrical member through-hole and said oil pressure source with respect to the movement of said outer cylindrical member toward said lever second end section.

18. An engine valve operating system as claimed in claim 17, further comprising means allowing the rotation of said outer cylindrical member in its peripheral direction.

19. An engine valve operating system as claimed in claim 18, wherein said outer cylindrical member is formed at the outer cylindrical surface with a pinion portion in engagement with said control rack.

20. An engine valve operating system as claimed in claim 8, further comprising means for controlling oil leakage from said oil pressure chamber into said oil reserving chamber in response to an engine operating parameter.

21. An engine valve operating system as claimed in claim 20, wherein said oil leakage controlling means includes:

an operating member having a disc section which is rotatable upon being driven by a control rack movable in response to the engine operating parameter, said disc section being formed at its bottom peripheral part with a cam contoured surface, and a needle section secured to the central section of said disc section and extending generally perpendicularly passing through said oil reserving chamber; and a connecting member interposed between said outer cylindrical member and said operating member disc section, one end of said connecting member being in contact with the cam contoured surface of said operating member disc section.

22. An engine valve operating system as claimed in claim 21, further comprising means for urging said operating member in the direction to open said check valve.

23. An engine valve operating system as claimed in claim 22, wherein said operating member disc section is formed at its peripheral surface with a pinion portion in engagement with said control rack.

24. An engine valve operating system as claimed in claim 13, further comprising means for controlling oil leakage from said oil pressure chamber to the outside of said hydraulic actuator in response to the rotational movement of said outer cylindrical member.

25. An engine valve operating system as claimed in claim 24, wherein said oil leakage controlling means includes:

means defining an oil leakage passage formed through the cylindrical wall of said outer cylindrical member, said oil leakage passage having a first end opened to said oil pressure chamber and a second end opened to the outer cylindrical surface of said outer cylindrical member; and means defining a control through-hole at the cylindrical wall of said control sleeve, through which control through-hole said oil leakage passage second end is communicable with the outside of said hydraulic actuator, said control through-hole having an axis which elongates generally in the peripheral direction of said control sleeve, the location of said axis in the axial direction of said control sleeve changing along the peripheral direction of said control sleeve.

26. An engine valve operating system as claimed in claim 25, wherein said control through-hole of said control sleeve is arranged such that a third plane containing the axis of said control through-hole is inclined relative to a fourth plane to which the axis of said control sleeve is perpendicular.

27. An engine valve operating system as claimed in claim 1, wherein said hydraulic actuator includes means for biasing said outer cylindrical member in said first direction.

28. An engine operating system as claimed in claim 27, wherein said biasing means for said outer cylindrical member includes a coil sping interposed between said inner and outer cylindrical members to bias said outer cylindrical member in said first direction.

* * * * *